US012704299B2

(12) United States Patent
Cossette-Labrosse et al.

(10) Patent No.: US 12,704,299 B2
(45) Date of Patent: Aug. 11, 2026

(54) HEAT EXCHANGE SYSTEM AND METHOD

(71) Applicant: MAXI-THERME INC., Montréal (CA)

(72) Inventors: Gabriel Cossette-Labrosse, Montréal (CA); Patrick Lach, Venise-en-Québec (CA)

(73) Assignee: MAXI-THERME INC., Montréal (CA)

( * ) Notice: Subject to any disclaimer, the term of this patent is extended or adjusted under 35 U.S.C. 154(b) by 213 days.

(21) Appl. No.: 18/607,718

(22) Filed: Mar. 18, 2024

(65) Prior Publication Data

US 2024/0310090 A1 Sep. 19, 2024

Related U.S. Application Data

(60) Provisional application No. 63/490,969, filed on Mar. 17, 2023.

(51) Int. Cl.
*F25B 41/20* (2021.01)

(52) U.S. Cl.
CPC ..... *F25B 41/20* (2021.01)

(58) Field of Classification Search
CPC .. F16K 31/1221; F16K 37/0016; F24D 17/00; F25B 41/20
See application file for complete search history.

(56) References Cited

U.S. PATENT DOCUMENTS 4,479,459 A * 10/1984 Piper ..... F22B 37/545 251/297
6,024,116 A * 2/2000 Almberg ..... F16K 31/003 122/504
6,857,467 B2 2/2005 Lach
2004/0154786 A1* 8/2004 Lach ..... F28F 27/02 165/110
2007/0187634 A1* 8/2007 Sneh ..... F16K 7/17 251/30.01
2016/0025383 A1* 1/2016 Shinozaki ..... F24S 70/65 126/572
2022/0356961 A1* 11/2022 Al Faihan ..... F15B 19/002

* cited by examiner

*Primary Examiner* — Henry T Crenshaw
(74) *Attorney, Agent, or Firm* — Jacob M. Ward; Ward Law Office LLC

(57) ABSTRACT

The heat exchange system includes a flooded heat exchanger unit where a first fluid is heated by a second fluid. The flooded heat exchanger has a second fluid circuit control valve at its downstream end. A steam detection device is connected to the second fluid circuit downstream of the heat exchanger. A normally closed valve is located on the second fluid circuit downstream of the heat exchanger. A normally closed valve actuator controls the normally closed valve to maintain it in its opened condition against the action of the normally closed mechanism of the normally closed valve. If steam is detected in the second fluid circuit downstream of the heat exchanger and upstream of the second fluid circuit control valve, the normally closed valve actuator will switch to its closed condition to shut off fluid flow to the second fluid circuit control valve.

20 Claims, 4 Drawing Sheets

- Prior Art -

HEAT EXCHANGE SYSTEM AND METHOD

CROSS-REFERENCE TO RELATED APPLICATIONS

This application claims the benefit of U.S. Provisional Application No. 63/490,969 filed on Mar. 17, 2023. The entire disclosure of the above application is incorporated herein by reference.

FIELD

The present technology relates to heat exchange systems, and more particularly to a heat exchange system and method by which a first fluid is heated by a second fluid in a flooded heat exchanger.

INTRODUCTION

This section provides background information related to the present disclosure which is not necessarily prior art.

Known heat exchange systems can be used for different purposes, such as for heating water used for domestic, commercial or industrial purposes. For example, a hotel requires a variable quantity of hot water for warm showers or other internal use such as for heating. At certain times during the day, hot water demand is lower, while at certain other times during the day, hot water demand is much higher, such as early morning when many clients take a shower at once.

FIG. 1 shows a fluid circuit of a prior art heat exchange system 10, such as the one shown in U.S. Pat. No. 6,857,467 issued in 2005 (inventor Raymond LACH). Heat exchange system 10 is destined to be used to heat a first colder fluid with a second hotter fluid.

Heat exchange system 10 comprises a first linear fluid circuit 12 made of pipes. First fluid circuit 12 comprises an upstream end 12*a*, a downstream end 12*b* and an intermediate portion 12*c* therebetween. The first fluid flows from first fluid circuit upstream end 12*a* to first fluid circuit downstream end 12*b*.

Heat exchange system 10 also comprises a second fluid circuit 14 also made of pipes. Second fluid circuit 14 comprises an upstream end 14*a*, a downstream end 14*b* and an intermediate portion 14*c* therebetween. The second fluid flows from second fluid circuit upstream end 14*a* to second fluid circuit downstream end 14*b*.

Isolation valves 16 are provided near the first and second fluid circuit upstream and downstream ends 12*a*, 12*b*, 14*a*, 14*b*. Isolation valves 16 are normally always opened to allow fluid flow therethrough, and can be selectively closed, for example for maintenance purposes.

Heat exchange system 10 further comprises a heat exchanger unit 18 where intermediate portions 12*c*, 14*c* of the first and second fluid circuits 12, 14 are in adjacent, thermally-conductive contact for allowing heat transfer from the second fluid to the first fluid such that the second heating fluid circulating in second fluid circuit 14 will heat the first fluid circulating in first fluid circuit 12—as detailed hereinafter. Heat exchanger unit 18 comprises a first fluid inlet 22*a*, a first fluid outlet 22*b*, a second fluid inlet 24*a* and a second fluid outlet 24*b*. Within heat exchanger unit 18, tubes (not shown) link the second fluid inlet and outlet 24*a* and 24*b*, while first fluid inlet and outlet 22*a* and 22*b* are linked on the shell side of heat exchanger unit 18 which may include baffles (not shown). In FIG. 1, both fluid intermediate portions are schematically shown with straight dotted lines within heat exchanger unit 18, but normal tube and baffle configurations of intermediate portions 12*c*, 14*c* will normally be used as obvious to a person skilled in the art.

In the heat exchange system 10 of FIG. 1, heat exchanger unit 18 is a flooded heat exchanger which is designed for allowing the second fluid, initially in a gaseous state at the second fluid inlet 24*a*, to condense inside the heat exchanger tubes, thereby flooding the second fluid circuit intermediate portion 14*c* to a variable degree. Condensation of a fluid is highly exothermic, which increases the efficiency of heat exchanger unit 18, compared to non-condensing heat exchanger units. By modulating the working load of the heat exchanger unit 18 (e.g., by varying inlet temperature or flow rate of the first fluid), the flooded heat exchanger unit 18 will react by varying the water level in second fluid intermediate portion 14*c* to adjust the heat exchange to the first fluid: the more second fluid circuit intermediate portion 14*c* is flooded with cooler liquid state fluid, the less heat is transferred to the first fluid; and inversely, the more second fluid circuit intermediate portion 14*c* is filled with hotter gaseous state fluid, the more heat is transferred to the first fluid.

Since both a flooded and a non-flooded portion of second fluid circuit intermediate portion 14*c* exist, so-called sub-cooling will occur in heat exchanger unit 18 due to the presence of the liquid-state second fluid column, i.e., the condensed liquid-state second fluid column will transfer heat to the first fluid in addition to heat transfer occurring from the condensed gaseous-state second fluid to the first fluid.

FIG. 1 shows that first fluid circuit 12 additionally comprises the following components located between first fluid circuit upstream end 12*a* and heat exchanger first fluid inlet 22*a*: an upstream fluid temperature indicator 30 capable of indicating the temperature of the first fluid at the first fluid circuit upstream end 12*a*; and a pair of serially installed check valves 34 located upstream of the heat exchanger inlet 22*a* for preventing accidental first fluid back flow. First fluid circuit 12 also comprises the following components located between heat exchanger first fluid outlet 22*b* and first fluid circuit downstream end 12*b*: a downstream fluid temperature indicator 32 capable of indicating the temperature of the first fluid at the first fluid circuit downstream end 12*b*; and a temperature/pressure security valve 36 which will allow emergency egress of the second fluid in case temperature or pressure thresholds are overstepped.

Second fluid circuit 14 comprises the following components located between second fluid circuit upstream end 14*a* and heat exchanger second fluid inlet 24*a*: an upstream manometer 38 to indicate the gaseous second fluid pressure near the second fluid circuit upstream end 14*a*; and an air eliminator 40 near the second fluid circuit upstream end 14*a* to eliminate the air from the second fluid circuit when the heat exchange system 10 is initialized from an empty state wherein second fluid circuit 14 is empty of second fluid before second fluid is fed to it. Air eliminator 40 also acts to remove non-condensable fluids (such as air) from second fluid circuit 14 during normal operation. Second fluid circuit 14 comprises the following components between heat exchanger second fluid outlet 24*b* and second fluid circuit downstream end 14*b*: an isolation valve 42 being normally in an opened condition to allow fluid flow therethrough; a strainer with screen 44 to filter sediments; a control valve 46, the purpose of which will be detailed hereinafter; an automatic bleed valve 48 downstream of control valve 46 to remove gaseous fluid from the second fluid circuit downstream of control valve 46; a steam trap 50 located downstream of bleed valve 48, for preventing gaseous-state second fluid from flowing therethrough in case of failure of control valve 46 that could remain stuck in an opened position; and a check valve 52 preventing fluid back flow.

Automatic bleed valve 48 is advantageously positioned immediately upstream of steam trap 50, since the latter may cause pressure to rise in some circumstances, and consequently the second fluid, normally in liquid state downstream of control valve 46, may occasionally undesirably vaporize into a gaseous state between control valve 46 and steam trap 50. Steam trap 50 may include a steam lock release option which allows not only the non-condensable gases to be evacuated through steam trap 50, but furthermore allows also condensable gases such as gaseous state second fluid to be evacuated therethrough, thereby further helping to prevent gaseous state second fluid presence within second fluid circuit 14 downstream of control valve 46. Indeed, gaseous-state second fluid in second fluid circuit 14 downstream of control valve 46 is likely to cause water hammers, which result from the sudden passage of the second fluid from gaseous state to liquid state and which cause implosions due to the vacuum suddenly caused by this change of state. Furthermore, any presence of gaseous-state fluid in second fluid circuit downstream of control valve 46 may prematurely force steam trap 50 to close and again cause water hammer problems.

Control valve 46 allows a variable and selectable flow rate of second fluid therethrough. A controller device 54 is linked to and controls control valve 46. Controller device 54 can be any type of known controller (pneumatic or electronic), for example a pneumatic controller device 54 that acts on control valve 46 by means of an air flow through a pneumatic circuit 56. An air regulator 58 controls the air pressure required at controller device 54. Controller device 54 may include a manually operable control means (not shown) which allows a selective adjustment of the control valve 46 opening; or more commonly, heat exchange system 10 may instead comprise a computer 59 for automatically controlling control valve 46 through air regulator 58 according to determined criteria. When control valve 46 is controlled to increase the second fluid flow rate within second fluid circuit 14, the flooding, i.e., the height of the liquid-state second fluid column within the tubes, will decrease, consequently increasing the proportion of the tubes which are occupied by hotter, gaseous-state second fluid, therefore increasing the heat exchange rate within heat exchanger unit 18. However, if control valve 46 is instead controlled to decrease the second fluid flow rate within the second fluid circuit, then the flooding, i.e., the height of the liquid-state second fluid column within the tubes, will increase, consequently decreasing the proportion of the tubes which are occupied by hotter, gaseous-state second fluid, therefore decreasing the heat exchange rate within heat exchanger unit 18.

Controller device 54 is operatively connected to first fluid circuit 12 near first fluid circuit downstream end 12*b*. Thus, controller device 54 can calibrate the opening of control valve 46 according to the first fluid temperature that it detects at first fluid circuit downstream end 12*b*, for instance at downstream fluid temperature indicator 32. If the first fluid temperature measured at downstream fluid temperature indicator 32 is colder than the setpoint temperature which has been manually programmed on controller device 54 or computer 59, then controller device 54 will control the control valve 46 to decrease the flooding in second fluid circuit intermediate portion 14*c*, thus increasing the heat exchange between the first and second fluids. Inversely, if the first fluid temperature measured at downstream fluid temperature indicator 32 is hotter than the setpoint temperature which has been manually programmed on controller device 54 or computer 59, then controller device 54 will control the control valve 46 to increase the flooding in second fluid circuit intermediate portion 14*c*, thus decreasing the heat exchange between the first and second fluids.

Anywhere from 0% to 100% of the tubes of the second fluid circuit 14 within heat exchanger unit 18 can be filled with gaseous-state second fluid, and inversely from 100% to 0% of the tubes will be filled with liquid-state second fluid. This allows for an improved control over the heat exchange within heat exchanger unit 18 compared to a fixed 100% gaseous state second fluid heat exchanger. Indeed, in the case where the first fluid to be heated is only slightly under the desired temperature or in the case where only a small flow rate of first fluid flows through first fluid circuit 12, the opening of control valve 46 will be only slightly increased, thus providing for a very small additional percentage of the tubes to be filled with hotter, gaseous-state second fluid. This will only slightly increase the heat exchange to the first fluid, which is less likely to become too hot. However, should the first fluid be much colder than the desired temperature or should the first fluid have an important flow rate through first fluid circuit 12, then a more important proportion of the tubes will be filled with hotter gaseous-state second fluid through a corresponding control of the opening of valve 46, and consequently the heat exchange will be desirably more important.

This calibrated control of the level of flooding within the tubes is especially advantageous at low working loads of heat exchange system 10. Indeed, in such a situation, where conventional heat exchanger units are likely to overheat the first fluid due to the use of hotter gaseous-state second fluid throughout the second fluid circuit intermediate portion, the flooded heat exchanger unit 18 can instead allow gaseous-state second fluid in only a small proportion of the tubes, which permits a smaller, more calibrated heat exchange between the first and second fluid, thus preventing first fluid overheating.

A stabilization circuit 60 is installed to form a loop within a portion of first fluid circuit 12. More particularly, stabilization circuit 60 defines a re-circulation inlet 60*a* which is connected to first fluid circuit 12 between heat exchanger first fluid outlet 22*b* and first fluid circuit downstream end 12*b*, and a re-circulation outlet 60*b* which is connected to first fluid circuit 12 between first fluid circuit upstream end 12*a* and heat exchanger first fluid inlet 22*a*. Stabilization circuit 60 allows a variable and selectable proportion of heated first fluid to be re-circulated through the first fluid circuit intermediate portion 12*c*, admixed with a quantity of colder first fluid flowing from the first fluid circuit upstream end 12*a*. Stabilization circuit 60 also comprises a re-circulation pump 62 to pump a determined quantity of fluid from re-circulation inlet 60*a* to re-circulation outlet 60*b*. A check valve 64 is provided to prevent accidental fluid back flow towards re-circulation inlet 60*a* through stabilization circuit 60.

The purpose of stabilization circuit 60 is to stabilize the first fluid temperature at the first fluid outlet 22*b* when inlet temperature or flow rate variations occur. This is accomplished by increasing the first fluid temperature at first fluid inlet 22*a*. Indeed, by having a fluid which is partly preheated by admixing hotter fluid from re-circulation circuit 60 with the colder fluid originating from the first fluid circuit upstream end 12*a*, the temperature of the mixed first fluid flowing into heat exchanger unit 18 is increased. Since higher temperature gradients require more gaseous-state second fluid in the tubes, and since more gaseous-state second fluid in the tubes means that it is more likely that the first fluid will eventually be overheated, having a hotter first fluid at the heat exchanger first fluid inlet increases the likelihood that the first fluid temperature will be more stable at the heat exchanger first fluid outlet 22*b*.

The use of a stabilization circuit 60 with a flooded heat exchanger unit 18 wherein the second fluid flow through second fluid circuit 14 is controlled by means of a control valve 46 located downstream of heat exchanger second fluid outlet 24*b* to selectively calibrate the height of the condensed second fluid column in the tubes, has provided advantageous results in obtaining an energetically efficient heat exchange system, wherein the first fluid is heated at a temperature which is very stable relative to the desired temperature, or in other words wherein the first fluid temperature at the heat exchanger first fluid outlet 22*b* has little variations relative to desired first fluid temperature, even under low working-load operation of heat exchange system 10.

A liquid-state second fluid evacuation circuit 66 is installed within second fluid circuit 14. More particularly, liquid-state second fluid evacuation circuit 66 has a liquid-state second fluid evacuation inlet 66*a* which is connected to second fluid circuit 14 downstream of second fluid circuit upstream end 14*a* and upstream of heat exchanger second fluid inlet 24*a*, and a liquid-state second fluid evacuation outlet 66*b* which is connected to second fluid circuit 14 downstream of steam trap 50 and upstream of second fluid circuit downstream end 14*b*. Liquid-state second fluid evacuation inlet 66*a* comprises a screen. Liquid-state second fluid evacuation outlet 66*b* comprises a mixer.

An automatic liquid-state bleed device 68 installed on water evacuation circuit 66 allows liquid-state fluid only to be re-directed towards the mixer at liquid-state second fluid evacuation outlet 66*b*. There, this liquid-state second fluid will be mixed with the colder liquid-state second fluid that flows through the tubes, and the resulting liquid-state second fluid will be conveyed towards second fluid circuit downstream end 14*b*, from where it will be conveyed to a suitable location.

Mixer 66*b* allows both liquid-state second fluid streams that are at different temperatures, namely the colder liquid coming from the heat exchanger unit 18 and the hotter liquid coming from liquid-state second fluid evacuation circuit 66, to be mixed without creating undesirable water hammers.

It is noted that in practice, some liquid-state second fluid re-vaporization will in fact occur downstream of automatic liquid-state bleed device 68.

Isolation valves 70, 70 are installed on either side of bleed device 68.

As mentioned above, the purpose of automatic bleed valve 48 is to remove gaseous fluid from the second fluid circuit between control valve 46 and steam trap 50; while the purpose of steam trap 50 is to prevent gaseous-state fluid from flowing therethrough in case of failure of control valve 46 which could remain stuck in an opened position. One problem with steam trap 50 is that it is a mechanical device that includes a suitable mechanism such as a floater that floats on the liquid-state fluid. If liquid state fluid is present, then the floater is lifted and the liquid is allowed to flow through. If there is gaseous-state fluid instead, the floater sinks and the fluid is prevented from passing. However, such a mechanical device is prone to occasional malfunction.

The bleed valve 48 is used to evacuate gaseous state fluid that might form upstream of steam trap 50 because of the very nature of steam trap 50. Indeed, the steam trap device 50 might cause steam to be undesirably generated upstream of it.

All that said, in practice, steam trap 50 very rarely comes into play at all, since there is no steam coming out of condensate outlet 24*b* of flooded heat exchanger 18 during normal use of the heat exchange system 10. It will only become useful in rare cases where the system operates in overload. The very nature of a flooded heat exchanger 18 is indeed that only liquid-state second (heating) fluid exists outlet 24*b*. Consequently, providing a steam strap 50 is a security measure in prior art system 10 that usually does not serve an actual function. It is, in the majority of cases, simply included as a security measure.

Accordingly, there is a need to provide an improved a heat exchange system and method by which a first fluid is heated by a second fluid in a flooded heat exchanger.

SUMMARY

In concordance with the instant disclosure, an improved a heat exchange system and method by which a first fluid is heated by a second fluid in a flooded heat exchanger, has surprisingly been discovered.

The present technology includes articles of manufacture, systems, and processes that relate to a heat exchange system for heating a first fluid by means of a second fluid in a flooded heat exchanger.

In one embodiment, a heat exchange system for heating a first fluid by means of a second fluid, can include a first fluid circuit comprising an upstream end, a downstream end and an intermediate portion therebetween, said first fluid circuit being destined to allow the first fluid to flow from said first fluid circuit upstream end to said first fluid circuit downstream end and a second fluid circuit comprising an upstream end, a downstream end and an intermediate portion therebetween, said second fluid circuit being destined to allow the second fluid to flow from said second fluid circuit upstream end to said second fluid circuit downstream end. The heat exchange system can also include a flooded heat exchanger unit wherein said intermediate portions of said first and second fluid circuits are in adjacent, thermally-conductive contact for allowing heat transfer from the second fluid to the first fluid for heating the first fluid, said flooded heat exchanger being capable of being flooded in a determined proportion within said second fluid circuit intermediate portion; a second fluid circuit control valve on said second fluid circuit downstream of said heat exchanger unit, for controlling the flow rate of the second fluid through said second fluid circuit, wherein the proportion of said heat exchanger which is flooded within said second fluid circuit intermediate portion can be selectively calibrated; a steam detection device connected to said second fluid circuit downstream of said heat exchanger, for detecting if steam is present in said second fluid circuit downstream of said heat exchanger. Aa fail-closed/normally closed valve can be provided located on said second fluid circuit downstream of said heat exchanger, said fail-closed/normally closed valve having an opened condition where it allows fluid flow to said second fluid circuit control valve, and a closed condition where it blocks fluid flow to said second fluid circuit control valve, said fail-closed/normally closed valve being continuously biased towards said closed condition with a normally closed mechanism. A fail-closed/normally closed valve actuator can be provided for controlling said fail-closed/normally closed valve to maintain said fail-closed/normally closed valve in its opened condition against the action of said normally closed mechanism under normal heat exchange operating conditions of said heat exchange system; wherein if steam is detected in said second fluid circuit at the position of said steam detection device by said steam detection device, said fail-closed/normally closed valve actuator ceases to maintain said fail-closed/normally closed valve in said opened condition such that said fail closed/normally closed valve will switch to its closed condition under the action of said normally closed mechanism to shut off fluid flow towards said second fluid circuit downstream end.

In one embodiment, said fail-closed/normally closed valve can be a spring return valve.

In one embodiment, said fail-closed/normally closed valve can be located upstream of said second fluid circuit control valve and said steam detection device can be located upstream of said second fluid circuit control valve and of said fail-closed/normally closed valve.

In one embodiment, said steam detection device can include a temperature sensor and said fail-closed/normally closed valve actuator will switch said fail-closed/normally closed valve to its closed condition when it detects that the temperature of said second fluid is above a determined threshold, which is indicative that steam is present in said second fluid circuit at the position of said steam detection device.

In one embodiment, said fail-closed/normally closed valve can include a visual indicator that indicates whether it is in its closed or opened condition.

In one embodiment, said normally closed mechanism can include at least one spring, and said fail-closed/normally closed valve actuator can use one of a pneumatic, a hydraulic and an electric control to force said spring return valve towards its opened condition against the action of said at least one spring.

In one embodiment, said spring return valve actuator can be connected to an electric control system that allows monitoring the opened and closed conditions of said spring return valve.

In one embodiment, said electrical control system can include a computer.

In one embodiment, said electrical control system can be further connected to said second fluid circuit control valve to close it if said spring return valve condition is switched to its closed condition.

The invention also relates to a method of controlling the fluid flow towards a control valve in a heat exchange system for heating a first fluid by means of a second fluid of the type comprising a first fluid circuit including an upstream end, a downstream end and an intermediate portion therebetween, said first fluid circuit being for allowing the first fluid to flow from said first fluid circuit upstream end to said first fluid circuit downstream end and a second fluid circuit including an upstream end, a downstream end and an intermediate portion therebetween, said second fluid circuit for allowing the second fluid to flow from said second fluid circuit upstream end to said second fluid circuit downstream end. The heat exchange system can include a flooded heat exchanger unit wherein said intermediate portions of said first and second fluid circuits are in adjacent, thermally-conductive contact for allowing heat transfer from the second fluid to the first fluid. A second fluid circuit control valve can be provided on said second fluid circuit downstream of said heat exchanger unit, for controlling the flow rate of the second fluid through said second fluid circuit, whereby said flooded heat exchanger is capable of being flooded in an adjustable proportion within said second fluid circuit intermediate portion to adjust the heat transfer rate from said second fluid to said first fluid. Said method can include the steps of providing a steam detection device connected to said second fluid circuit downstream of said heat exchanger, for detecting if steam is present in said second fluid circuit downstream of said heat exchanger; providing a fail-closed/normally closed valve on said second fluid circuit downstream of said heat exchanger, said fail-closed/normally closed valve having an opened condition where it allows fluid flow to said second fluid circuit control valve, and a closed condition where it blocks fluid flow to said second fluid circuit control valve; continuously forcing said fail-closed/normally closed valve into its closed condition with a normally closed mechanism; providing a fail-closed/normally closed valve actuator that controls said fail-closed/normally closed valve between said opened and closed conditions; maintaining, with said fail-closed/normally closed valve actuator, said fail-closed/normally closed valve in its opened condition under normal heat exchange operating conditions of said heat exchange system against the action of said normal closed mechanism; and, if steam is detected in said second fluid circuit at the position of said steam detection device by said steam detection device, ceasing to maintain said fail-closed/normally closed valve in said opened condition with said fail-closed/normally closed valve actuator to switch said fail-closed/normally closed valve to its closed condition to shut off fluid flow towards said second fluid circuit downstream end.

In one embodiment, said steam detection device can include a temperature sensor, with the step of ceasing to maintain said fail-closed/normally closed valve in said opened condition with said fail-closed/normally closed valve actuator to switch said fail-closed/normally closed valve to its closed condition is accomplished when said temperature sensor detects that the temperature of said second fluid is above a determined threshold, which is indicative that steam is present in said second fluid circuit at the position of said steam detection device.

In one embodiment, said fail-closed/normally closed valve can be a spring return valve, the step of continuously forcing said fail-closed/normally closed valve into its closed condition with a normally closed mechanism can include mechanically continuously biasing said spring return valve towards its closed condition with at least one spring, and the step of maintaining, with said fail-closed/normally closed valve actuator, said fail-closed/normally closed valve in its opened condition under normal heat exchange operating conditions of said heat exchange system against the action of said normal closed mechanism can include using one of a pneumatic, a hydraulic and an electric control to force said spring return valve towards its opened condition against the action of said spring.

The invention further relates to a heat exchange system including a flooded heat exchanger unit where a first fluid in a first fluid circuit is heated by a second fluid in a second fluid circuit. The heat exchange system can be provided with a second fluid circuit control valve at a downstream end of said heat exchanger on unit on said second fluid circuit and a steam detection device connected to said second fluid circuit downstream of said heat exchanger. A fail-closed/normally closed valve can be provided located on said second fluid circuit downstream of said heat exchanger, said fail closed/normally closed valve have opened and closed conditions and comprising a normally closed mechanism continuously biasing said fail closed/normally closed valve towards said closed condition; and a fail-closed/normally closed valve actuator that controls said fail-closed/normally closed valve to maintain it in its opened condition against action of said normally closed mechanism, wherein if steam is detected in said second fluid circuit downstream of said heat exchanger, said fail-closed/normally closed valve actuator will switch said fail closed/normally closed valve to its closed condition to shut off fluid flow to said second fluid circuit control valve.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
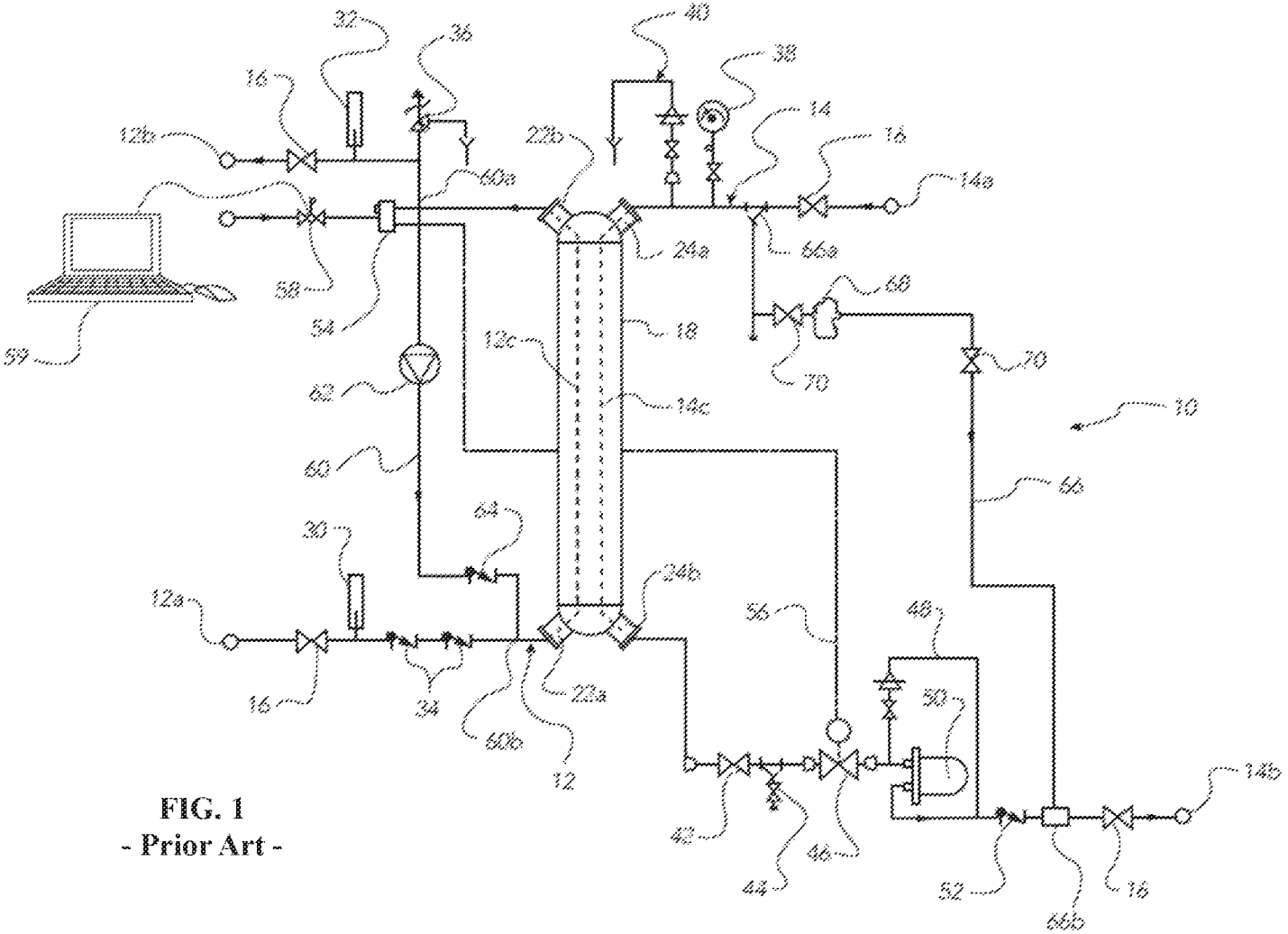
FIG. 1 is a schematic view of a prior art heat exchange system.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology improves heat exchange systems and methods by which a first fluid is heated by a second fluid in a flooded heat exchanger.

Figure 2:
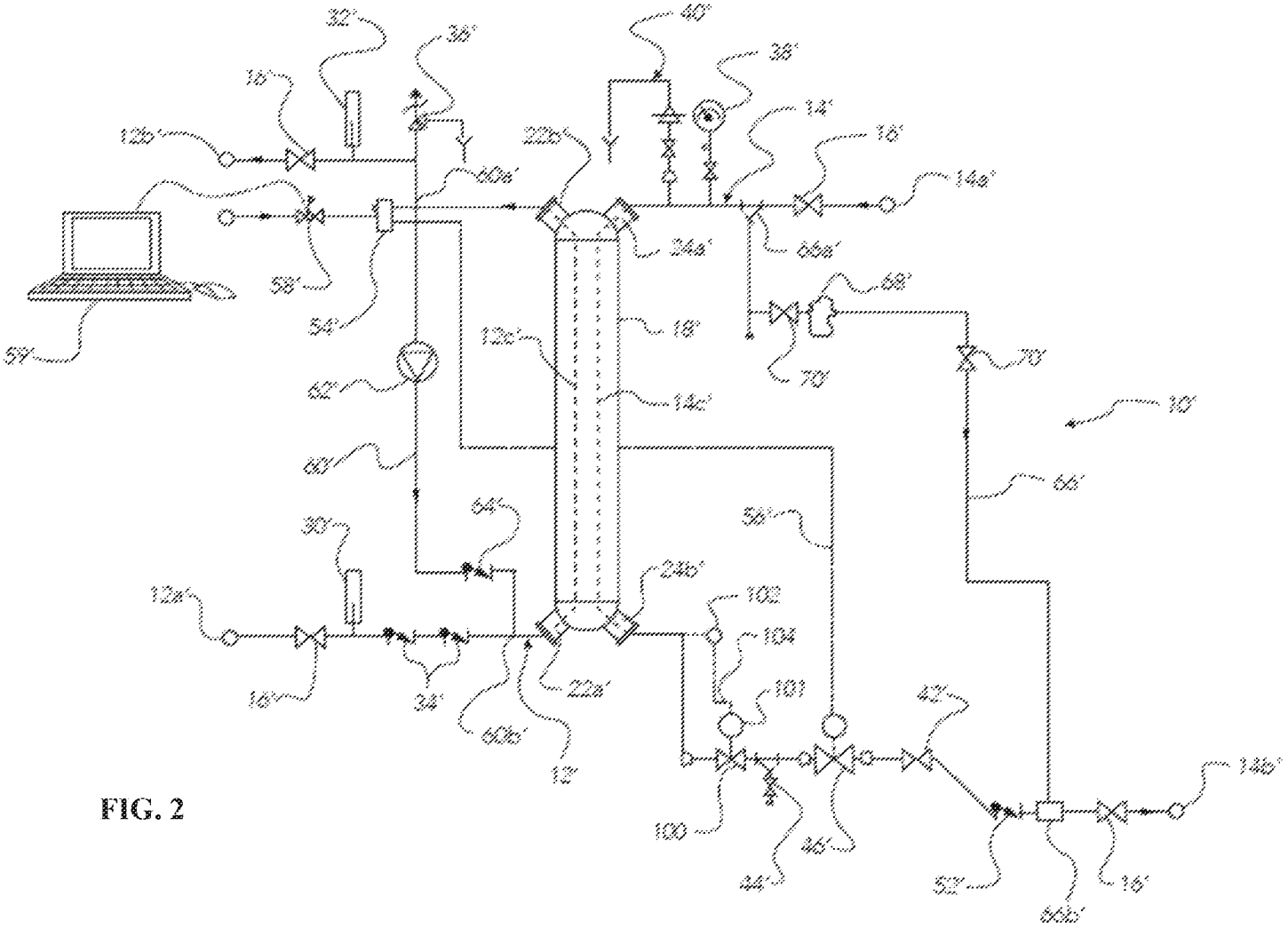
FIG. 2 is a schematic view of a heat exchange system according to the present invention.

In certain embodiments, FIG. 2 shows a heat exchange system 10' according to the present invention, which is similar to the one shown in the prior art system of FIG. 1, and which is also used to heat a first colder fluid with a second hotter fluid. As such, most reference numbers from FIG. 1 are repeated in FIG. 2, albeit with a primed number, and those primed numbers represent structures that are similar or identical to the corresponding non-primed numbers in FIG. 1. The functioning of heat exchange system 10' of FIG. 2 is very similar to the one of FIG. 1, except as noted hereinafter. To refer to the differences between the heat exchange systems 10 and 10' more easily, structures that are added in heat exchange system 10' are identified with reference numbers 100 or more.

Heat exchange system 10' comprises a first linear fluid circuit 12' made of pipes or the like fluid-tight carrying medium of known construction. First fluid circuit 12' comprises an upstream end 12*a*', a downstream end 12*b*' and an intermediate portion 12*c*' therebetween. The first fluid flows from first fluid circuit upstream end 12*a*' to first fluid circuit downstream end 12*b*'.

Heat exchange system 10' also comprises a second fluid circuit 14' also made of pipes or the like fluid-tight carrying medium of known construction. Second fluid circuit 14' comprises an upstream end 14*a*', a downstream end 14*b*' and an intermediate portion 14*c*' therebetween. The second fluid flows from second fluid circuit upstream end 14*a*' to second fluid circuit downstream end 14*b*'.

Isolation valves 16' are provided near the first and second fluid circuit upstream and downstream ends 12*a*', 12*b*', 14*a*', 14*b*'. Isolation valves 16' are normally always opened to allow fluid flow therethrough, and can be selectively closed, for example for maintenance purposes.

Heat exchange system 10' further comprises a heat exchanger unit 18' where intermediate portions 12*c*', 14*c*' of the first and second fluid circuits 12', 14' are in adjacent, thermally-conductive contact for allowing heat transfer from the second fluid to the first fluid such that the second heating fluid circulating in second fluid circuit 14' will heat the first fluid circulating in first fluid circuit 12'—as detailed hereinafter. Heat exchanger unit 18' comprises a first fluid inlet 22*a*', a first fluid outlet 22*b*', a second fluid inlet 24*a* and a second fluid outlet 24*b*'. Tubes (not shown) link the second fluid inlet and outlet 24*a*' and 24*b*', while first fluid inlet and outlet 22*a*' and 22*b*' are linked on the shell side of heat exchanger unit 18' which may include baffles (not shown). In FIG. 2, both fluid intermediate portions are schematically shown with straight dotted lines within heat exchanger unit 18', but normal tube and baffle configurations of intermediate portions 12*c*', 14*c*' will normally be used as obvious to a person skilled in the art.

In the heat exchange system 10' of FIG. 2, heat exchanger unit 18' is a flooded heat exchanger which is designed for allowing the second fluid, initially in a gaseous state at the second fluid inlet 24*a*', to condense inside the heat exchanger tubes (not shown, but present in second fluid circuit intermediate portion 14*c*' within heat exchanger 18'), thereby flooding the second fluid circuit intermediate portion 14*c*' to a variable degree. Condensation of a fluid is highly exothermic, which increases the efficiency of heat exchanger unit 18', compared to non-condensing heat exchanger units. By modulating the working load of the heat exchanger unit 18' (e.g., by varying inlet temperature or flow rate of the first fluid), the flooded heat exchanger unit 18' will react by varying the water level in second fluid intermediate portion 14*c*' to adjust the heat exchange to the first fluid: the more second fluid circuit intermediate portion 14*c*' is flooded with cooler liquid state fluid, the less heat is transferred to the first fluid; and inversely, the more second fluid circuit intermediate portion 14*c*' is filled with hotter gaseous state fluid, the more heat is transferred to the first fluid.

Since both a flooded and a non-flooded portion of second fluid circuit intermediate portion 14*c*' exist, so-called subcooling will occur in heat exchanger unit 18' due to the presence of the liquid-state second fluid column, i.e., the condensed liquid-state second fluid column will transfer heat to the first fluid in addition to heat transfer occurring from the condensed gaseous-state second fluid to the first fluid.

FIG. 2 shows that first fluid circuit 12' additionally comprises the following components located between first fluid circuit upstream end 12*a*' and heat exchanger first fluid inlet 22*a*': an upstream fluid temperature indicator 30' capable of indicating the temperature of the first fluid at the first fluid circuit upstream end 12*a*'; and a pair of serially installed check valves 34' located upstream of the heat exchanger inlet 22*a*' for preventing accidental first fluid back flow. First fluid circuit 12' also comprises the following components located between heat exchanger first fluid outlet 22*b*' and first fluid circuit downstream end 12*b*': a downstream fluid temperature indicator 32' capable of indicating the temperature of the first fluid at the first fluid circuit downstream end 12*b*'; and a temperature/pressure security valve 36' which will allow emergency egress of the second fluid in case temperature or pressure thresholds are overstepped.

Second fluid circuit 14' comprises the following components located between second fluid circuit upstream end 14*a*' and heat exchanger second fluid inlet 24*a*': an upstream manometer 38' to indicate the gaseous second fluid pressure near the second fluid circuit upstream end 14*a*'; and an air eliminator 40' near the second fluid circuit upstream end 14*a*' to eliminate the air from the second fluid circuit when the heat exchange system 10' is initialized from an empty state wherein second fluid circuit 14' is empty of second fluid before second fluid is fed to it. Air eliminator 40' also acts to remove non-condensable fluids (such as air) from second fluid circuit 14' during normal operation. Second fluid circuit 14' comprises the following components between heat exchanger second fluid outlet 24*b*' and second fluid circuit downstream end 14*b*': an isolation valve 42' being normally in an opened condition to allow fluid flow therethrough; a strainer with screen 44' to filter sediments; a control valve 46', the purpose of which will be detailed hereinafter; and a check valve 52' preventing fluid back flow.

Control valve 46' allows a variable and selectable flow rate of second fluid therethrough. A controller device 54' is linked to and controls control valve 46'. Controller device 54' can be any type of known controller (pneumatic or electronic), for example a pneumatic controller device 54' that acts on control valve 46' by means of an air flow through a pneumatic circuit 56'. An air regulator 58' controls the air pressure required at controller device 54'. Controller device 54' may include a manually operable control means (not shown) which allows a selective adjustment of the control valve 46' opening; or heat exchange system 10' may instead comprise a computer 59' for automatically controlling control valve 46' through air regulator 58' according to determined criteria. When control valve 46' is controlled to increase the second fluid flow rate within second fluid circuit 14', the flooding, i.e., the height of the liquid-state second fluid column within the tubes, will decrease, consequently increasing the proportion of the tubes which are occupied by hotter, gaseous-state second fluid, therefore increasing the heat exchange rate within heat exchanger unit 18'. However, if control valve 46' is instead controlled to decrease the second fluid flow rate within the second fluid circuit, then the flooding, i.e., the height of the liquid-state second fluid column within the tubes, will increase, consequently decreasing the proportion of the tubes which are occupied by hotter, gaseous-state second fluid, therefore decreasing the heat exchange rate within heat exchanger unit 18'.

Controller device 54' is operatively connected to first fluid circuit 12' near first fluid circuit downstream end 12*b*'. Thus, controller device 54' can calibrate the opening of control valve 46' according to the first fluid temperature that it detects at first fluid circuit downstream end 12*b*', for instance at downstream fluid temperature indicator 32'. If the first fluid temperature measured at downstream fluid temperature indicator 32' is colder than the setpoint temperature which has been manually programmed on controller device 54' or computer 59', then controller device 54' will control the control valve 46' to decrease the flooding in second fluid circuit intermediate portion 14*c*', thus increasing the heat exchange between the first and second fluids. Inversely, if the first fluid temperature measured at downstream fluid temperature indicator 32' is hotter than the setpoint temperature which has been manually programmed on controller device 54' or computer 59', then controller device 54' will control the control valve 46' to increase the flooding in second fluid circuit intermediate portion 14*c*', thus decreasing the heat exchange between the first and second fluids.

Anywhere from 0% to 100% of the tubes of the second fluid circuit 14' within heat exchanger unit 18' can be filled with gaseous-state second fluid, and inversely from 100% to 0% of the tubes will be filled with liquid-state second fluid. This allows for an improved control over the heat exchange within heat exchanger unit 18' compared to a fixed 100% gaseous state second fluid heat exchanger. Indeed, in the case where the first fluid to be heated is only slightly under the desired temperature or in the case where only a small flow rate of first fluid flows through first fluid circuit 12', the opening of control valve 46' will be only slightly increased, thus providing for a very small additional percentage of the tubes to be filled with hotter, gaseous-state second fluid. This will only slightly increase the heat exchange to the first fluid, which is less likely to become too hot. However, should the first fluid be much colder than the desired temperature or should the first fluid have an important flow rate through first fluid circuit 12', then a more important proportion of the tubes will be filled with hotter gaseous-state second fluid through a corresponding control of the opening of valve 46', and consequently the heat exchange will be desirably more important.

This calibrated control of the level of flooding within the tubes is especially advantageous at low working loads of heat exchange system 10'. Indeed, in such a situation, where conventional heat exchanger units are likely to overheat the first fluid due to the use of hotter gaseous-state second fluid throughout the second fluid circuit intermediate portion, the flooded heat exchanger unit 18' can instead allow gaseous-state second fluid in only a small proportion of the tubes, which permits a smaller, more calibrated heat exchange between the first and second fluid, thus preventing first fluid overheating.

A stabilization circuit 60' is installed to form a loop within a portion of first fluid circuit 12'. More particularly, stabilization circuit 60' defines a re-circulation inlet 60*a*' which is connected to first fluid circuit 12' between heat exchanger first fluid outlet 22*b*' and first fluid circuit downstream end 12*b*', and a re-circulation outlet 60*b*' which is connected to first fluid circuit 12' between first fluid circuit upstream end 12*a*' and heat exchanger first fluid inlet 22*a*'. Stabilization circuit 60' allows a variable and selectable proportion of heated first fluid to be re-circulated through the first fluid circuit intermediate portion 12*c*', admixed with a quantity of colder first fluid flowing from the first fluid circuit upstream end 12*a*'. Stabilization circuit 60' also comprises a re-circulation pump 62' to pump a determined quantity of fluid from re-circulation inlet 60*a*' to re-circulation outlet 60*b*'. A check valve 64' is provided to prevent accidental fluid back flow towards re-circulation inlet 60*a*' through stabilization circuit 60'.

The purpose of stabilization circuit 60' is to stabilize the first fluid temperature at the first fluid outlet 22*b*' when inlet temperature or flow rate variations occur. This is accomplished by increasing the first fluid temperature at first fluid inlet 22*a*'. Indeed, by having a fluid which is partly preheated by admixing hotter fluid from re-circulation circuit 60' with the colder fluid originating from the first fluid circuit upstream end 12*a*', the temperature of the mixed first fluid flowing into heat exchanger unit 18' is increased. Since higher temperature gradients require more gaseous-state second fluid in the tubes, and since more gaseous-state second fluid in the tubes means that it is more likely that the first fluid will eventually be overheated, having a hotter first fluid at the heat exchanger first fluid inlet increases the likelihood that the first fluid temperature will be more stable at the heat exchanger first fluid outlet 22*b*'.

The use of a stabilization circuit 60' with a flooded heat exchanger unit 18' wherein the second fluid flow through second fluid circuit 14' is controlled by means of a control valve 46' located downstream of heat exchanger second fluid outlet 24*b*' to selectively calibrate the height of the condensed second fluid column in the tubes, has provided advantageous results in obtaining an energetically efficient heat exchange system, wherein the first fluid is heated at a temperature which is very stable relative to the desired temperature, or in other words wherein the first fluid temperature at the heat exchanger first fluid outlet 22*b*' has little variations relative to desired first fluid temperature, even under low working-load operation of heat exchange system 10'.

A liquid-state second fluid evacuation circuit 66' is installed within second fluid circuit 14'. More particularly, liquid-state second fluid evacuation circuit 66' has a liquid-state second fluid evacuation inlet 66*a* which is connected to second fluid circuit 14' downstream of second fluid circuit upstream end 14*a*' and upstream of heat exchanger second fluid inlet 24*a*', and a liquid-state second fluid evacuation outlet 66*b*' which is connected to second fluid circuit 14' downstream of check valve 52' and upstream of second fluid circuit downstream end 14*b*'. Liquid-state second fluid evacuation inlet 66*a*' comprises a screen. Liquid-state second fluid evacuation outlet 66*b*' comprises a mixer.

An automatic liquid-state bleed device 68' installed on water evacuation circuit 66' allows liquid-state fluid only to be re-directed towards the mixer at liquid-state second fluid evacuation outlet 66*b*'. There, this liquid-state second fluid will be mixed with the colder liquid-state second fluid that flows through the tubes, and the resulting liquid-state second fluid will be conveyed towards second fluid circuit downstream end 14*b*', from where it will be conveyed to a suitable location.

Mixer 66*b*' allows both liquid-state second fluid streams that are at different temperatures, namely the colder liquid coming from the heat exchanger unit 18' and the hotter liquid coming from liquid-state second fluid evacuation circuit 66', to be mixed without creating undesirable water hammers.

It is noted that in practice, some liquid-state second fluid re-vaporization will in fact occur downstream of automatic liquid-state bleed device 68'.

Isolation valves 70' are installed on either side of bleed device 68'.

In FIG. 2, the first and second fluid inlets 22*a*', 24*a*' are provided at opposite extremities of heat exchanger unit 18', as are the first and second fluid outlets 22*b*', 24*b*', to allow first and second fluid counter-current flow within heat exchanger 18'. It is understood, however, that first and second fluid co-current flow could instead be used, wherein the first fluid inlet would be adjacent the second fluid inlet at a first extremity of the heat exchanger unit, and the first fluid outlet would be adjacent the second fluid outlet at a second extremity of the heat exchanger unit.

Alternately, the stabilization circuit 60' could be replaced with any suitable first fluid pre-heating means by which the first fluid would be preheated before it enters the heat exchanger unit 18, such as heating electrical resistances or the like. However, the first fluid stabilization circuit provides a few important advantages which make it preferable over other preheating means: (1) it is energetically efficient, since only a low electrically consuming pump is required; (2) the first fluid will not be overheated in any circumstance, since the re-circulated first fluid will at most have the temperature required at first fluid circuit downstream end 12*b*.

Although the heat exchange system of FIG. 2 is not limited thereto, many applications use water as the fluid that circulates in both fluid circuits 12', 14' (partly in vapor state in second fluid circuit 14' as noted above).

Another advantage of the prior art heat exchange system 10' relies on the fact that the second fluid control valve 46' is provided downstream of the heat exchanger second fluid outlet 24*b*', such that the second fluid pressure remains at a high level in the second fluid circuit 14', which allows the second fluid circuit to operate without any additional pump being required near the second fluid circuit downstream end. Also, since heat exchanger unit 18' is a flooded heat exchanger, the pressure and temperature of the incoming gaseous-state second fluid do not have to be reduced in low working-load of the heat exchanger unit 18' to prevent overheating of the first fluid. Only the flooding of the second fluid intermediate portion 14*c*' needs to be controlled.

According to the invention heat exchange system 10' of the present invention, a fail-closed/normally closed valve 100 is installed downstream of heat exchanger outlet 24*b*' and upstream of control valve 46'. Fail-closed/normally closed valve 100 can be in one of two conditions: opened or closed. When opened, fluid may flow through. When closed, fluid is prevented from flowing through. The expression normally closed applies to valves that remain closed unless acted upon to change their condition to opened. The expression fail-closed refers to a valve that would go switch automatically to a closed condition on a control signal failure. The control signal may be pneumatic, hydraulic or electric.

More specifically, valve actuator 101 will maintain fail-closed/normally closed valve 100 in its opened condition under normal operation of system 10' against the action of a normally closed mechanism in fail-closed/normally closed valve 100. That is to say fail-closed/normally closed valve 100 is opened during operation of the heat exchange system, unless there is an interruption of the control signal from valve actuator 101 in which case fail-closed/normally closed valve 100 will automatically switch to its closed condition.

A temperature sensor 102 detects the temperature of second fluid at, or downstream of, the outlet 24*b*' of the heat exchanger 18', and upstream of second fluid circuit control valve 46'. Temperature sensor 102 is connected to valve actuator 101 by a command line 104 (or wirelessly). If sensor 102 detects an increase in second heating fluid temperature, which is indicative of steam being present in the pipes, then controller 101 will cease to maintain fail-closed/normally closed valve 100 in its open condition, which means that the normally closed mechanism of fail-closed/normally closed valve 100 will force it into its closed condition to prevent fluid to flow through.

Figure 3:
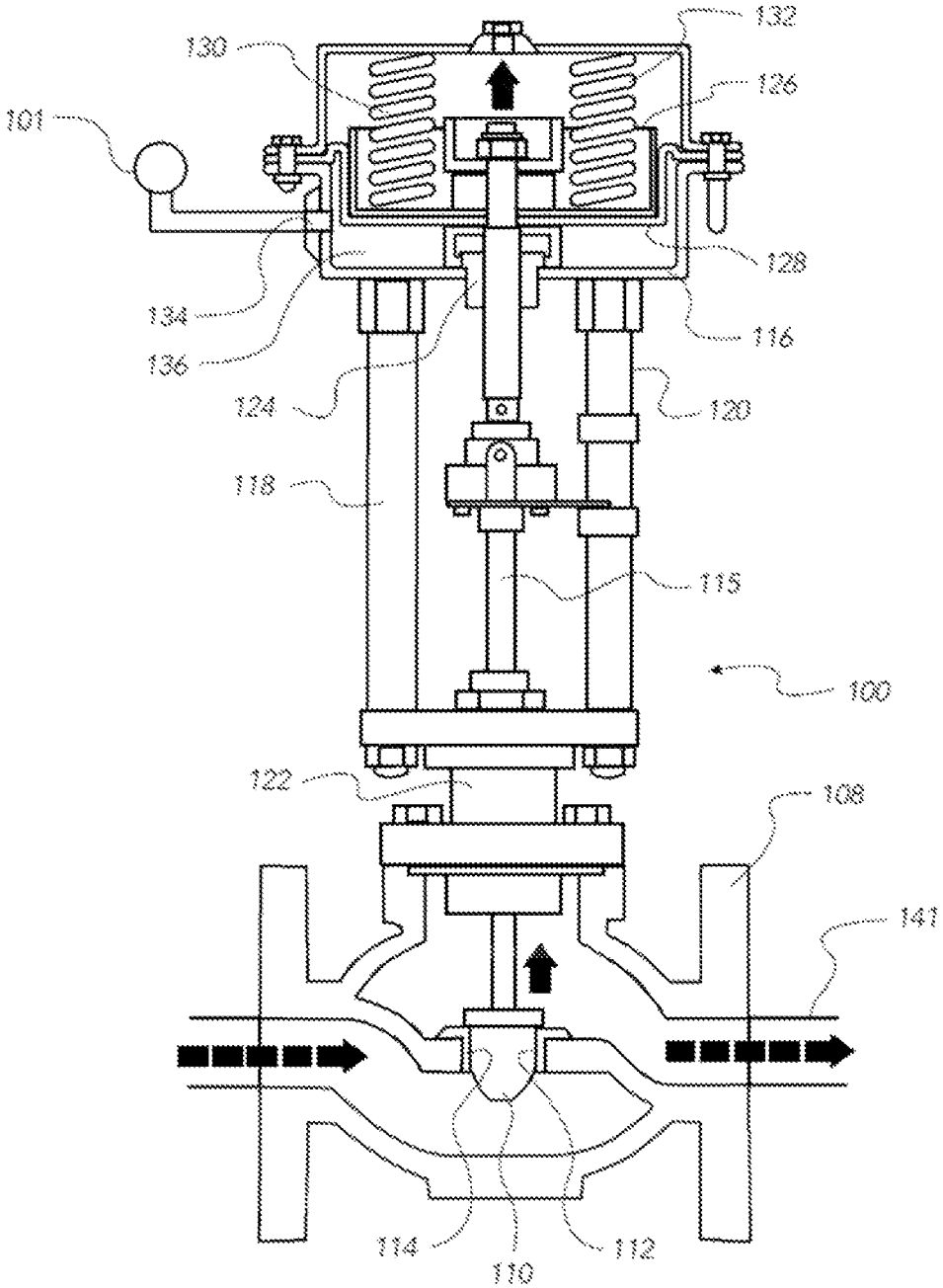
FIG. 3 is a schematic cross-sectional elevation of a fail-closed/normally closed valve used in the heat exchange system of FIG. 2.

FIG. 3 shows one example of a fail-closed/normally closed valve 100 embodied as a pneumatically controlled spring return valve 100.

Spring return valve 100 of FIG. 3 comprises a valve body 108 connected to second fluid circuit 14'. A plug 110 extends within body 108 to engage a passage 112 between a closed position shown in FIG. 3 where it blocks passage 112 such that the second fluid may not flow through passage 112 and an opened position (not shown) where it is moved out of passage 112 such that fluid may flow through passage 112. A seat ring 114 seals the interface between plug 110 and body 108 in passage 112.

Spring return valve 100 also comprises an air-tight casing 116 carried by body 108 with a pair of carrying bars 118, 120 and a body sleeve 122 with the latter extending through body 108. An actuation rod 115 extends through body sleeve 122 and through a casing sleeve 124 that extends through casing 116. Actuation rod carries plug 110 at one end thereof and is attached to a spring box 126 within casing 116 at its other end. Spring box 126 is carried by a flexible diaphragm 128 such that it is movable between a first position shown in FIG. 3 where plug 110 is in its closed position, and a second position (not shown) where it is moved away from valve body 108 and where plug 110 is in its opened position. A pair of springs 130, 132 continuously bias spring box 126 towards its first position, and consequently, also continuously bias plug 110 towards its closed position. Because of this biasing action of springs 130, 132 that act as a normally closed mechanism, spring return valve 100 of FIG. 3 is consequently said to be of the normally closed type.

Valve actuator 101 is connected to an air inlet 134 of casing 116 to provide airflow into an inner chamber 136 of casing 116 on an opposite side of diaphragm relative to springs 130, 132.

During normal heat exchange operation of heat exchange system 10' where the first fluid is being heated by the second fluid, valve actuator 101 injects air into inner chamber 136 which pushes on diaphragm 128 and in turn which forces spring box 126 towards its second position against the bias of springs 130, 132. This forces plug 110 in its open position. It is only if a control signal ceases to be received from valve actuator 101 that air injection will be interrupted, consequently allowing springs 130, 132 to force plug 110 into its closed position. Because of this, spring return valve 100 of FIG. 3 is said to be of the fail-closed type.

A fail-closed/normally closed valve such as spring return valve 100 of FIG. 3 is a security measure to prevent steam to flow to control valve 46', in replacement of seam trap 50 of the prior art system 10. If steam is detected in second fluid circuit 14' by temperature sensor 102, the fail-closed/normally closed valve actuator 101 ceases to maintain the spring return valve 100 in the opened condition such that it will switch to its closed condition under the action of springs 130, 132, to shut off fluid flow to the second fluid circuit control valve 46'.

One problem with the use of steam trap 50 in the prior art system 10 is that it includes a steam outlet orifice with a limited capacity that will inevitably yield a pressure loss. This is of course undesirable. The fail-closed/normally close valve 100 of the system 10' of the invention, on the contrary, will not yield any pressure loss.

Figure 4:
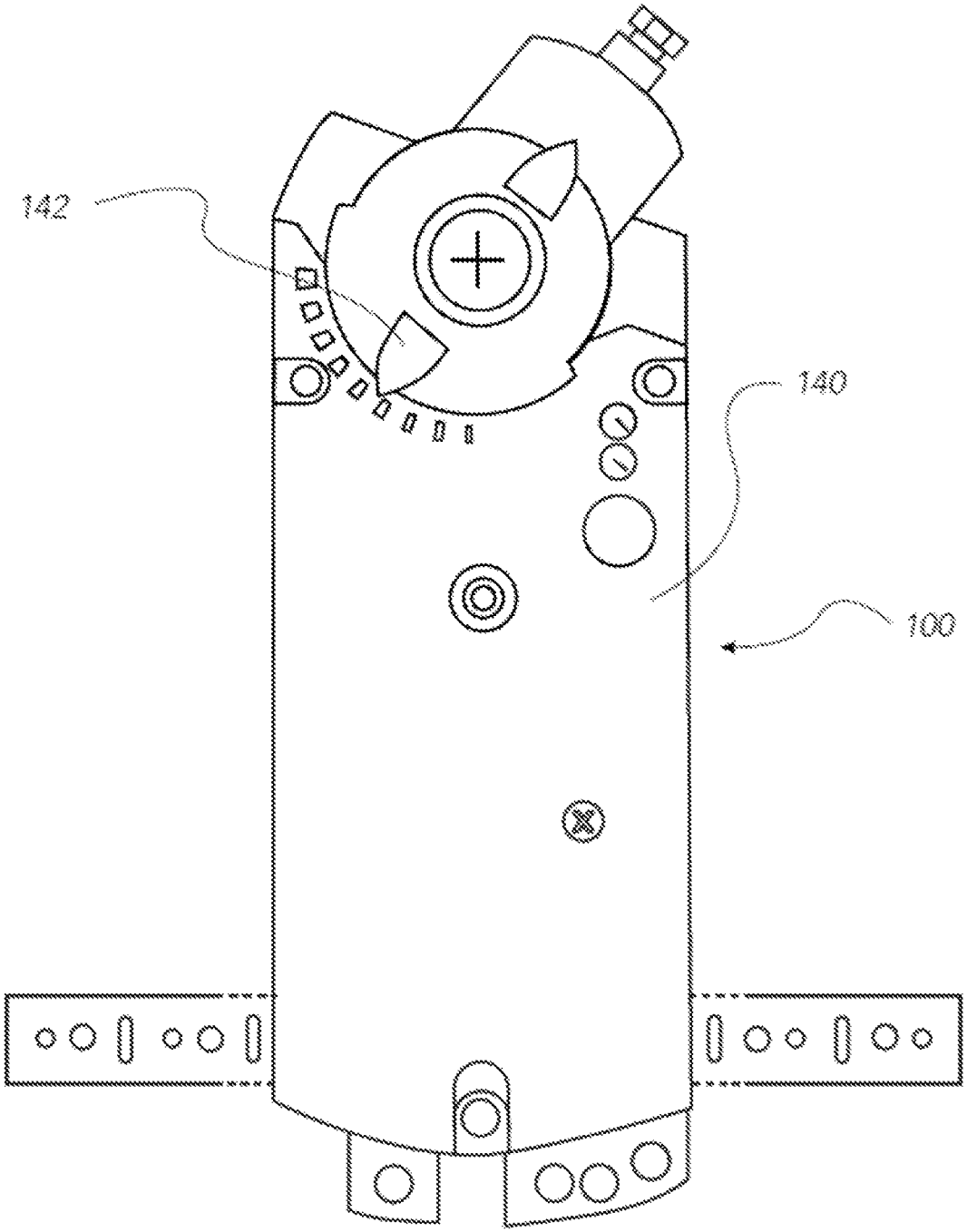
FIG. 4 is a top plan view of the exterior housing of the fail-closed/normally closed valve used in the heat exchange system of FIGS. 2 and 3.

Another problem with steam trap 50 in the prior art system 10 is that there is no visual indicator that allows to determine whether it is opened or closed, i.e., whether it is letting fluid out (particularly gaseous fluid). FIG. 4 shows an outer housing 140 of spring return valve 100 of the system 10' of the invention, which is provided with a visual indicator 142 such that it is possible to know in what condition it is, opened or closed.

Steam trap 50 of the prior art system 10 is further entirely mechanical. Fail-closed/normally closed valve 100 of the system 10' of the invention, on the contrary, reacts to a hydraulic, electrical or pneumatic control, and as such, it can be connected to an electric control system, for example to computer 59', making it possible to monitor its status or condition, opened or closed. If fail-closed/normally closed valve 100 were to close due to steam at the outlet **24*b*' of heat exchanger 18', then a warning could be issued at computer 59', and/or the heat exchange system 10'** could be stopped.

It is noted that fail-closed/normally closed valve 100 is shown to be located upstream of second fluid circuit control valve 46', but it could be located downstream thereof. Likewise, the temperature sensor 102 is shown to be located upstream of fail-closed/normally close valve 100 and upstream of second fluid circuit control valve 46', but it could also be located downstream thereof instead. Strainer screen 44' is shown to be located downstream of fail-closed/normally closed valve 100, but it could alternately be located upstream thereof instead, between heat exchanger second fluid outlet **24*b*' and valve 100**.

Generally, the invention relates to a method of controlling the fluid flow towards a control valve 46' in a heat exchange system 10' for heating a first fluid by means of a second fluid, the method comprising the steps of:

providing a steam detection device such as a temperature sensor 102, which is connected to the second fluid circuit 14' downstream of the heat exchanger 18', and optionally upstream of the control valve 46', for detecting if steam is present in the second fluid circuit 14' downstream of the heat exchanger 18';

providing a fail-closed/normally closed valve 100 on the second fluid circuit 14' downstream of the heat exchanger 18', and optionally upstream of the second fluid circuit control valve 46', the fail-closed/normally closed valve 100 having an opened condition where it allows fluid flow to the second fluid circuit control valve 46', and a closed condition where it blocks fluid flow to the second fluid circuit control valve 46';

continuously forcing the fail-closed/normally closed valve 100 into its closed condition with a normally closed mechanism, such as the springs 130, 132 for example;

providing a fail-closed/normally closed valve actuator 101 to control the fail-closed/normally closed valve 100;

maintaining, with the fail-closed/normally closed valve actuator 101, the fail-closed/normally closed valve 100 in its opened condition under normal heat exchange operating conditions of the heat exchange system 10' against the action of the normal closed mechanism; and if steam is detected in the second fluid circuit 14' at the position of the steam detection device 102 by the steam detection device 102, ceasing to maintain the fail-closed/normally closed valve 100 in the opened condition with the fail-closed/normally closed valve actuator 101 to switch the fail-closed/normally closed valve 100 to its closed condition to shut off fluid flow to the second fluid circuit control valve 46'.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A heat exchange system for heating a first fluid by means of a second fluid, comprising:

a first fluid circuit comprising an upstream end, a downstream end and an intermediate portion therebetween, said first fluid circuit configured to allow the first fluid to flow from said first fluid circuit upstream end to said first fluid circuit downstream end;

a second fluid circuit comprising an upstream end, a downstream end and an intermediate portion therebetween, said second fluid circuit configured to allow the second fluid to flow from said second fluid circuit upstream end to said second fluid circuit downstream end;

a flooded heat exchanger wherein said intermediate portions of said first and second fluid circuits are in adjacent, thermally-conductive contact for allowing heat transfer from the second fluid to the first fluid for heating the first fluid, said flooded heat exchanger being capable of being flooded in a determined proportion within said second fluid circuit intermediate portion;

a control valve on said second fluid circuit downstream of said flooded heat exchanger, for controlling a flow rate of the second fluid through said second fluid circuit, wherein the proportion of said flooded heat exchanger which is flooded within said second fluid circuit intermediate portion can be selectively calibrated;

a steam detection device comprising at least one temperature sensor and associated signal output circuitry configured to generate a signal indicative of vapor-phase steam presence connected to said second fluid circuit downstream of said flooded heat exchanger, for detecting if steam is present in said second fluid circuit downstream of said flooded heat exchanger;

a fail-closed/normally closed valve located on said second fluid circuit downstream of said flooded heat exchanger, said fail-closed/normally closed valve having an opened condition where it allows fluid flow to said control valve, and a closed condition where it blocks fluid flow to said control valve, said fail-closed/normally closed valve being continuously biased towards said closed condition with a normally closed mechanism; and a fail-closed/normally closed valve actuator controlling said fail-closed/normally closed valve to maintain said fail-closed/normally closed valve in its opened condition against the action of said normally closed mechanism under normal heat exchange operating conditions of said heat exchange system;

wherein if steam is detected in said second fluid circuit at the position of said steam detection device by said steam detection device, said fail-closed/normally closed valve actuator ceases to maintain said fail-closed/normally closed valve in said opened condition such that said fail-closed/normally closed valve will switch to its closed condition under the action of said normally closed mechanism to shut off fluid flow towards said second fluid circuit downstream end.

2. A heat exchange system as defined in claim 1, wherein said fail-closed/normally closed valve is a spring return valve.

3. A heat exchange system as defined in claim 1, wherein said fail-closed/normally closed valve is located upstream of said control valve and said steam detection device is located upstream of said control valve and of said fail-closed/normally closed valve.

4. A heat exchange system as defined in claim 1, wherein said steam detection device comprises a temperature sensor and said fail-closed/normally closed valve actuator will switch said fail-closed/normally closed valve to its closed condition when it detects that the temperature of said second fluid is above a determined threshold, which is indicative that steam is present in said second fluid circuit at the position of said steam detection device.

5. A heat exchange system as defined in claim 1, wherein said fail-closed/normally closed valve comprises a visual indicator comprising at least one visual cue device mounted on a housing of the system and electrically connected to said steam detection device that indicates whether said failed-closed/normally closed valve is in its closed or opened condition.

6. A heat exchange system as defined in claim 2, wherein said normally closed mechanism comprises at least one spring, and said fail-closed/normally closed valve actuator uses one of a pneumatic, a hydraulic and an electric control to force said spring return valve towards its opened condition against the action of said at least one spring.

7. A heat exchange system as defined in claim 6, wherein said spring return valve actuator is connected to an electric control system comprising at least one programmable controller including a processor, configured to receive said signal from said steam detection device and control operation of said valve actuator.

8. A heat exchange system as defined in claim 7, wherein said electrical control system comprises a computer.

9. A heat exchange system as defined in claim 8, wherein said electrical control system is further connected to said control valve to close it if said spring return valve condition is switched to its closed condition.

10. A method of controlling a fluid flow towards a control valve in a heat exchange system for heating a first fluid by means of a second fluid, said heat exchange system comprising:

a first fluid circuit comprising an upstream end, a downstream end and an intermediate portion therebetween, said first fluid circuit being for allowing the first fluid to flow from said first fluid circuit upstream end to said first fluid circuit downstream end;

a second fluid circuit comprising an upstream end, a downstream end and an intermediate portion therebetween, said second fluid circuit for allowing the second fluid to flow from said second fluid circuit upstream end to said second fluid circuit downstream end;

a flooded heat exchanger wherein said intermediate portions of said first and second fluid circuits are in adjacent, thermally-conductive contact for allowing heat transfer from the second fluid to the first fluid; and the control valve being provided on said second fluid circuit downstream of said flooded heat exchanger, for controlling a flow rate of the second fluid through said second fluid circuit, whereby said flooded heat exchanger is capable of being flooded in an adjustable proportion within said second fluid circuit intermediate portion to adjust the heat transfer rate from said second fluid to said first fluid;

said method comprising the steps of:

providing a steam detection device comprising at least one temperature sensor and associated signal output circuitry configured to generate a signal indicative of vapor-phase steam presence and connected to said second fluid circuit downstream of said flooded heat exchanger, for detecting if steam is present in said second fluid circuit downstream of said flooded heat exchanger;

providing a fail-closed/normally closed valve on said second fluid circuit downstream of said flooded heat exchanger, said fail-closed/normally closed valve having an opened condition where it allows fluid flow to said circuit control valve, and a closed condition where it blocks fluid flow to said control valve;

continuously forcing said fail-closed/normally closed valve into its closed condition with a normally closed mechanism;

providing a fail-closed/normally closed valve actuator that controls said fail-closed/normally closed valve between said opened and closed conditions;

maintaining, with said fail-closed/normally closed valve actuator, said fail-closed/normally closed valve in its opened condition under normal heat exchange operating conditions of said heat exchange system against the action of said normal closed mechanism; and if steam is detected in said second fluid circuit at the position of said steam detection device by said steam detection device, ceasing to maintain said fail-closed/ normally closed valve in said opened condition with said fail-closed/normally closed valve actuator to switch said fail-closed/normally closed valve to its closed condition to shut off fluid flow towards said second fluid circuit downstream end.

11. The method as defined in claim 10, wherein said fail-closed/normally closed valve is a spring return valve and the step of continuously forcing said fail-closed/normally closed valve into its closed condition with a normally closed mechanism comprises mechanically continuously biasing said spring return valve towards its closed condition with at least one spring.

12. The method as defined in claim 11, wherein the step of maintaining, with said fail-closed/normally closed valve actuator, said fail-closed/normally closed valve in its opened condition under normal heat exchange operating conditions of said heat exchange system against the action of said normal closed mechanism comprises using one of a pneumatic, a hydraulic and an electric control to force said spring return valve towards its opened condition against the action of said spring.

13. The method as defined in claim 12, wherein said spring return valve actuator is connected to an electric control system, with the method further comprising monitoring the opened and closed conditions of said spring return valve.

14. The method as defined in claim 13, wherein said electrical control system comprises a computer.

15. The method as defined in claim 14, wherein said electrical control system is further connected to said control valve to close it if said spring return valve condition is switched to said closed condition.

16. The method as defined in claim 10, wherein said fail-closed/normally closed valve is located upstream of said control valve and said steam detection device is located upstream of said control valve and of said fail-closed/normally closed valve.

17. The method of controlling the fluid flow towards a control valve in a heat exchange system as defined in claim 10, wherein said steam detection device comprises a temperature sensor, with the step of ceasing to maintain said fail-closed/normally closed valve in said opened condition with said fail-closed/normally closed valve actuator to switch said fail-closed/normally closed valve to its closed condition is accomplished when said temperature sensor detects that the temperature of said second fluid is above a determined threshold, which is indicative that steam is present in said second fluid circuit at the position of said steam detection device.

18. The method of controlling the fluid flow towards a control valve in a heat exchange system as defined in claim 10, wherein said fail-closed/normally closed valve comprises a visual indicator that indicates whether it is in its closed or opened condition.

19. A heat exchange system comprising:

a flooded heat exchanger where a first fluid in a first fluid circuit is heated by a second fluid in a second fluid circuit;

a control valve at a downstream end of said flooded heat exchanger on said second fluid circuit;

a steam detection device comprising at least one temperature sensor and associated signal output circuitry configured to generate a signal indicative of vapor-phase steam presence and connected to said second fluid circuit downstream of said heat exchanger;

a fail-closed/normally closed valve located on said second fluid circuit downstream of said flooded heat exchanger, said fail closed/normally closed valve have opened and closed conditions and comprising a normally closed mechanism continuously biasing said fail closed/normally closed valve towards said closed condition; and a fail-closed/normally closed valve actuator that controls said fail-closed/normally closed valve to maintain it in its opened condition against action of said normally closed mechanism;

wherein if steam is detected in said second fluid circuit downstream of said flooded heat exchanger, said fail-closed/normally closed valve actuator will switch said fail closed/normally closed valve to its closed condition to shut off fluid flow to said control valve.

20. A heat exchange system as defined in claim 19, wherein said fail-closed/normally closed valve is located upstream of said control valve and said steam detection device is located upstream of said control valve and of said fail-closed/normally closed valve.

* * * * *